United States Patent [19]

Pedersen

[11] 4,218,883

[45] Aug. 26, 1980

[54] HYDRAULIC SYSTEM FOR OPERATION OF TWO WINCHES

[75] Inventor: Håkon S. Pedersen, Hop, Norway

[73] Assignee: A/S Bergens Mekaniske Verksteder, Bergen, Norway

[21] Appl. No.: 934,848

[22] Filed: Aug. 18, 1978

[51] Int. Cl.[2] ..... F15B 11/20

[52] U.S. Cl. ..... 60/427; 60/429; 60/486; 60/905

[58] Field of Search ..... 60/427, 428, 429, 435, 60/468–483, 486, 494, 905; 254/172, 150 FH

[56] References Cited

U.S. PATENT DOCUMENTS

| | | | |
|---|---|---|---|
| 2,395,302 | 2/1946 | Slomer | 60/905 X |
| 3,499,286 | 3/1970 | Reischl | 60/483 X |
| 3,757,524 | 9/1973 | Poyner et al. | 60/905 X |

*Primary Examiner*—Edgar W. Geoghegan

*Attorney, Agent, or Firm*—Young & Thompson

[57] ABSTRACT

Hydraulic system for operation of winches which are associated with powered friction pulleys for hauling a wire, the winch winding the wire onto the drum being provided with valves permitting the friction pulleys to idle freely when it is convenient to use the winch drum proper also for hauling the wire.

6 Claims, 1 Drawing Figure

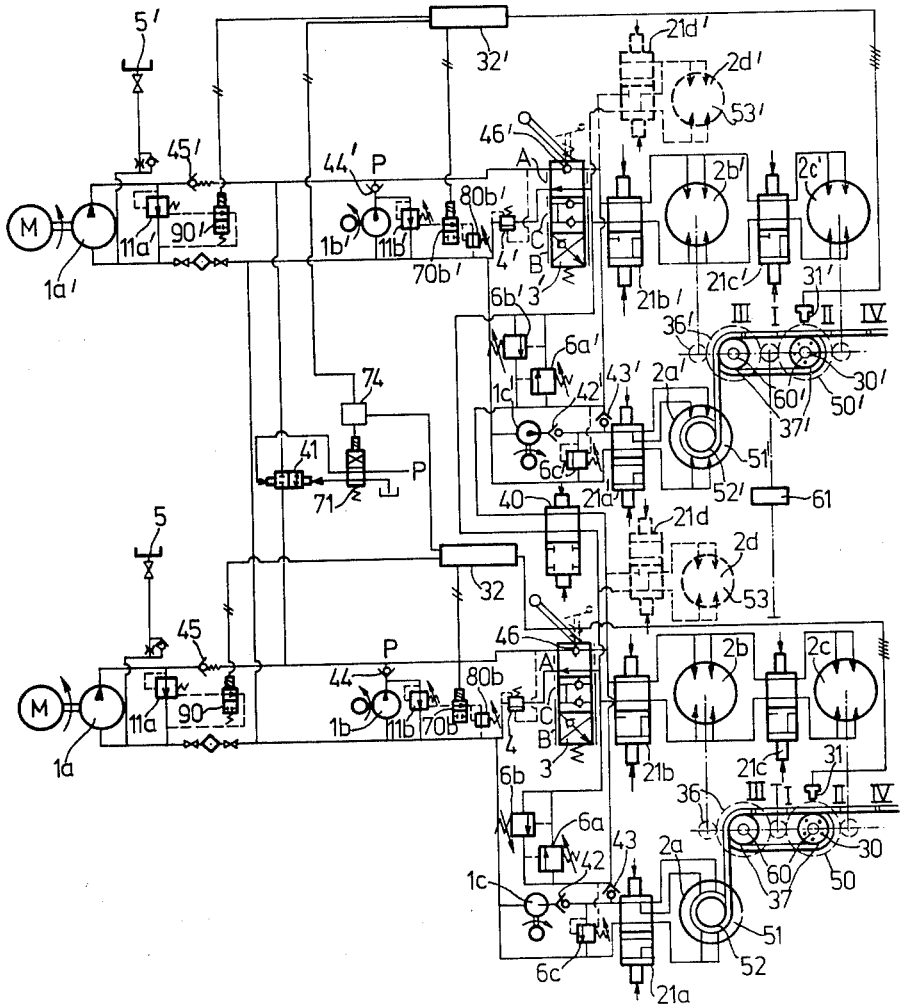
5'
32'
21d'
2d'
53'
46'
45'
44'
P
A
2b'
2c'
80b'
M
11a'
90'
1b'
11b'
C
B'
4'
1a'
70b'
6b'
3
21b'
21c'
31'
III
I
II
IV
36'
6a'
74
1c'
42
43'
2a'
30'
60'
50'
37'
41
6c'
51'
P
71
52'
61
40
21a'
21d
2d
53
5
32
45
46
A'
2b
2c
44
80b
M
11a
90
1b
11b
70b
C
B'
4
3
21b
21c
31
6b
36
III
I
II
IV
6a
43
2a
30
1c
42
60
50
37
51
52
6c
21a

HYDRAULIC SYSTEM FOR OPERATION OF TWO WINCHES

The present invention relates to a hydraulic system for the operation of winches for various purposes, particularly for maintaining a predetermined tension in wires when used for hauling trawls and mooring of semi submersible platforms for oil well drilling and production.

When used for hauling trawls one winch for each of the two wires will be provided and in order to enable the trawl to work properly, the hydraulic system with which the winch is associated is designed to maintain a predetermined tension in each of the wires. Several measures have been provided in order to take various irregular conditions into consideration viz. when trawling with heavy side currents, trawling in bad weather and under conditions which arise when one of the otter boards becomes stuck or passes obstacles on the bottom of the sea.

When the winches are used for mooring semi submersible platforms, the tension in the wires is so adjusted that the platform will be located at the correct position independently of heavy weather and winds in one particular direction and one or more wires should be paid out when they are hit for example by drifting icebergs.

The maintenance of a predetermined tension in the wires is caused by the fact that the diameter of a coil of wire and therefore the moment arm acting on the wire will decrease when wire is paid out and again increased when wire is hauled in by being wound on the winch drum. For this reason winches have been combined with power operated friction pulleys which are in direct engagement with the wire and exert the required tension in same, controlled by various means. The friction pulleys are also used for hauling the wire and it is arduous for the winch drum merely to wind or unwind the wire which is hauled in or paid out by the friction pulleys. The moment arm of the pulleys will at all times be the same and this fact has to a certain extent simplified the design of the hydraulic or mechanical components of the winch.

A disadvantage in the previously known systems is, however that the friction pulleys have a relatively low speed of rotation as there are usually gear trains between the motor or motors which operate the pulleys. This disadvantage is very pronounced when long wire lengths are to be hauled in with little load on the wires.

The object of the present invention is therefore to provide a hydraulic system of the kind described in which it is possible to haul in the wire at high speed when required and this is achieved by using the winch and its drum not only for coiling up the wire, but also for hauling in same, the friction pulleys then being disconnected hydraulically and, under special circumstances also mechanically.

The invention consequently provides a hydraulic system for the operation of winches, each being associated with friction pulleys driven by one or more motors, the winch drum having a separate motor for winding wire hauled in by the friction pulleys and comprising valves for the control of the operation of the motors and the invention is characterized in that the hydraulic system is provided with valves for disconnection of the motors for the friction pulleys and for transfer of the available hydraulic driving medium to the motor of the winch drum.

Other features and details claimed in the claims will be evident from the following description with reference to the drawing which shows a circuit diagram for a hydraulic system according to the invention.

On the drawing the hydraulic circuit is designed for two winches which could be the port and starboard winches on a trawler or two of several winches used for mooring a semi submersible platform. Three pumps 1*a*, 1*b* and 1*c* (1*a*', 1*b*' and 1*c*') for each winch can be driven by diesel engines or electric motors and as an alternative the pumps 1*a* (1*a*') can be driven by a main diesel engine and the pumps 1*b* and 1*c* (1*b*'and 1*c*') may be driven by an auxiliary diesel engine or an electric motor.

A maneouvering valve 3 (3') controls the delivery of oil from the pumps 1*a* and 1*b* (1*a*' and 1*b*') to and from the hydraulic motors 2*a* and 2*b* and 2*c* or 2*d* (2*a*', 2*b*' and 2*c*' or 2*d*').

The pumps 1*a*, 1*b* and 1*a*', 1*b*' can be in continuous operation. It is however possible to load one pump or other for each winch or both may be loaded simultaneously. When an electromagnetic valve 90, 90' is supplied with electricity it will be held in open position as shown and the safety valve 11*a*, 11*a*' will then be drained and relieve the pump 1*a*, 1*a*'.

When the electricity is cut off from the valve 90, 90' it will by a spring be moved to closed position, opposite to what is shown on the drawing and the pump 1*a*, 1*a*' may then be loaded as the safety valve 11*a*, 11*a*' will open only in response to a predetermined permissible maximum pressure.

The pump 1*b*, 1*b*' for each of the winches is connected in the same way by letting an electromagnetic valve 70*b*, 70*b*' control the valve 11*b*, 11*b*' when the pumps are to be relieved or loaded. The valve 11*b*, 11*b*' is also adjusted to open when acted upon by a predetermined allowed maximum pressure.

The valves 90, 90' and 70*b*, 70*b*' are controlled by a counter 32, 32' but they may also be adjusted manually so that an operator can choose the load on the various pumps.

It is also evident from the drawing that when said valve 70*b*, 70*b*' is in open position as shown, the valve 11*b*, 11*b*' can be controlled by an adjustable pilot valve 80*b*, 80*b*'. By adjusting the valve 80*b*, 80*b*', preferably by remote control, the load on the pump 1*b*, 1*b*' can be adjusted continuously from approximately unloaded condition to full maximum load.

The valve 80*b*, 80*b*' is particularly useful when the pump 1*b*, 1*b*' is used for compensation of creep or leakage in the winch motors. The valve 80*b*, 80*b*' can then be set to a pressure which, when the valves 3' are in the position shown, will cause for example the motors, 2*b*, 2*b*', 2*c*, 2*c*', 2*a*, and 2*a*' to exert a torque which counterbalances the torque exerted by the tension in the wires.

When the wire is to be hauled in, the friction pulley 50, 50' is brought into operation and the associated storage winch 51, 51'will rotate and collect the wire by winding same onto the winch drum 52, 52'. When this work is to be carried out, a valve 40 is moved to the opposite position of that shown on the drawing, and a valve 41 will when open convey the delivery from one or both pumps 1*a*, 1*a*', 1*b*, 1*b*' through the maneouvering valve 3, 3' via step valves 21*b*, 21*b*' and 21*c*, 21*c*', to motors 2*b*, 2*b*' and 2*c*, 2*c*'. The motors drive the pulleys 37, 37' by means of a gear transmission and intermediate gears 36, 36' and mechanical couplings 60, 60'.

The friction pulleys 50, 50' will haul in a wire with high power in relation to the storage winch 51, 51' which winds the wire onto the drum 52, 52' with a suitable tension. The motor 2a, 2a' of the winches can therefore be directly coupled with the winch drum 52, 52' without gearing. The motor 2a, 2a' has a pressure conduit in common with the motors 2b, 2b' and 2c, 2c' and is supplied with pressurized oil through a check valve 43, 43' and step valve 21a, 21a'. The motors have in the examples shown two chambers.

If the load on the wire is very small, the speed of the friction pulleys may be unduly slow and according to the invention it is possible to disconnect the friction pulley unit and let the winch 51, 51' do the hauling in, in addition to winding the wire for storage.

This can be done by moving the step valve 21c, 21c' to a position opposite to that shown. This will disconnect the motor 2c, 2c' hydraulically. At the same time the step valve 21a, 21a' may be moved to a position opposite to that shown and this will disconnect one chamber in the motor 2a, 2a'. Thereby the pulling power will be reduced to one half and the speed of the wire will be doubled.

By moving the step valve 21b, 21b' to the opposite position, while the step valves 21a, 21a' remain in the position shown, both motors 2b, 2b' and 2c, 2c' are disconnected hydraulically so that the delivery from the pump is transferred to both chambers of the motors 2a, 2a'. As these motors are directly connected to the winch drums 52, 52' the two wires would be hauled in with high speed but low pulling power.

To prevent the motors 2b, 2b' and 2c, 2c' from rotating at excessive speed in this situation it is also possible to disconnect said motors mechanically by means of couplings 60, 60'.

By moving both step valves 21b, 21b' and 21a, 21a' to a position opposite to that shown on the drawing the pump delivery will take place to one chamber of the motor 2a, 2a' whereby the speed of rotation is doubled once more.

Paying out of slack wire is possible by moving the maneouvering valve 3 from position C to position B. When the step valve 21b, 21b' is in the position shown and the step valves 21c, 21c' and 21a, 21a' are in the position opposite to that shown on the drawing, the pump delivery is conveyed to the motor 2b, 2b' which is one of the motors for the friction pulleys. The motor and the pulleys are driven counter clockwise so that when wire is paid out the motor 2c, 2c' is short circuited on the pressure side and therefore hydraulically disconnected. The motor 2a, 2a' for each of the winches is brought into rotation by the wire which is being paid out and the check valve 43 will close. Oil from the motor 2a, 2a' and the pump 1c, 1c' flows through the valve 6c, 6c'.

When wire is to be paid out under load, the maneouvering valve 3, 3' is moved from stop position C to position B. The delivery from the pump flows through the maneouvering valve 3, 3' and the step valves 21b, 21b' and 21c, 21c', said valves being in the position shown and the motors 2b, 2b' and 2c, 2c' will then rotate counterclockwise. When the maneouvering valve 3, 3' is in the end position B the motors 2b, 2b' and 2c, 2c' will be driven by the load as pumps, delivering oil under pressure to the pressure reducing valve 4, 4'. The valves 4, 4' will restrict the quantity of oil corresponding to the pump delivery from the pumps 1a, 1a' and/or 1b, 1b'. Further a variable quantity of oil will flow through the valve 6a, 6a' which on the drawing is an adjustable overflow valve. The load can thereby be lowered with a speed which is independent of the oil delivery from the pumps 1a, 1a' and/or 1b, 1b'. The valves 6a, 6a' and 6b, 6b' can be manually adjusted or they can be adjusted by the maneouvering valve 3, 3' in such a manner that minimum braking torque is obtained with the valve 3, 3' in end position B and maximum braking torque is obtained in the center position C.

It is evident from the drawing, that the motors of the friction pulleys, for example the friction pulley 50 at the lower part of the circuit diagram on the drawing is supplied with oil from the pumps 1a, 1b through the maneouvering valve 3, but the delivery from the pumps 1a' and 1b' can also be supplied to the friction pulley 50 by means of the maneouvering valves 3' and the valve 40. The energy supplied to the motors of the friction pulley 50 will then be doubled and consequently the wire speed will also be doubled since the rotational speed for the motors 2a, 2b and 2c is twice the usual speed. The valves 21a, 21b and 21c, 21d, 40 and 21d' must then be in the position shown while the valve 21b' is in the opposite position. It may then be required to prevent the winch 51' from rotating, for example by means of a brake during the time all the energy in the system is supplied to the motors 2b, 2c of the friction pulley 50.

The hydraulic system shown is symmetrical in that it is possible to convey all the available energy when required, to the motors 2b', 2c' while the winch 51 and the friction pulley 50 remains stationary.

Further it is possible to connect the friction pulleys 50, 50' mechanically by means of a mechanical coupling 61. For example the friction pulley 50 may then be driven by the four motors 2b', 2c', 2b and 2c and as they are two-chamber motors the speed of rotation can be adjusted hydraulically by adjusting the number of motor chambers in operation.

The pulling power of the friction pulley 50 will then be twice the pulling power when driven by two motors, but of course this leaves no power for the friction pulley 50'.

Due to leakage which can not be avoided in the motors for the friction pulleys and the winches, they will creep when the wires are under load and the valves are closed to arrest the wires in the desired position. To avoid the effects of creeping a creep compensating pump 1c, 1c' is provided for each of the winches. The pump 1c, 1c' is able to deliver an oil quantity which is larger than the internal leakage in the motor 2a, 2a'. The pump 1c, 1c' is continuously delivering oil to the motor 2a, 2a' through a valve 42, 42' and creates a pressure which will close the valve 43, 43'. The pressure is limited by the valve 6c, 6c' and is counterbalanced by the spring in the valve 6c, 6c' plus the control pressure from the pressure side of the motor 2b, 2b' and 2c, 2c'. In this way the pump 1c, 1c' will create a pressure slightly above the pressure in the motors 2b, 2b', 2c, 2c'.

The example shown will only serve to illustrate the invention and the protection offered by this patent is not limited other than by the appended claims.

Having described my invention, I claim:

1. Hydraulic system for operation of winches each having friction pulleys and a winch drum, said pulleys and drums being powered by hydraulic motors driven by hydraulic pumps comprising conduits supplying of energy to the motors and valves for control of same, wherein valves are provided for disconnecting the friction pulley motors hydraulically and for supplying of available energy to the winch drum motor.

2. Hydraulic system as claimed in claim 1, having a plurality of winches and friction pulleys in interconnected hydraulic circuits wherein valves are provided for supplying of available energy to one winch of said plurality.

3. Hydraulic system as claimed in claim 1, wherein each of the friction pulley motors is controlled by a two-position valve which in one position supplied and returns hydraulic driving medium to the motor and in the other position short-circuits the motor hydraulically for free idling.

4. Hydraulic system as claimed in claim 2, wherein the motors are two-chamber motors and are provided with valves for hydraulic disconnection of one chamber and supplying of available driving medium to the other chamber.

5. Hydraulic system as claimed in claim 2, wherein the plurality of friction pulleys are mechanically interconnected.

6. Hydraulic system as claimed in claim 5, wherein the interconnection is provided with a releasable mechanical coupling.

* * * * *